United States Patent [19]

Katz et al.

[11] Patent Number: 4,835,341

[45] Date of Patent: May 30, 1989

[54] ELECTRICAL INSULATOR FOR USE IN PLASMA ENVIRONMENT

[75] Inventors: Ira Katz, Escondido; James R. Cooper, San Diego, both of Calif.

[73] Assignee: Maxwell Laboratories, Inc., San Diego, Calif.

[21] Appl. No.: 165,618

[22] Filed: Mar. 8, 1988

[51] Int. Cl.[4] ..... H01B 17/26; H01B 17/42

[52] U.S. Cl. ..... 174/142; 174/140 R

[58] Field of Search ..... 174/140 R, 140 LR, 141 R, 174/142, 152 E, 211

[56] References Cited

U.S. PATENT DOCUMENTS

| | | | |
|---|---|---|---|
| 1,199,467 | 9/1916 | Jackson | 174/142 |
| 2,209,003 | 7/1940 | Rorden | 174/142 X |
| 3,126,439 | 3/1964 | Denholm et al. | 174/142 X |
| 3,627,906 | 12/1971 | Kurz et al. | 174/143 |
| 3,878,321 | 4/1975 | Ely | 174/140 S X |
| 3,967,051 | 6/1976 | Moore et al. | 174/143 |
| 4,107,455 | 8/1978 | Richards | 174/140 R |
| 4,255,615 | 3/1981 | Huang et al. | 174/140 CR |
| 4,524,404 | 6/1985 | Verma | 174/140 R X |
| 4,563,544 | 1/1986 | Bui et al. | 174/211 X |

FOREIGN PATENT DOCUMENTS

| | | | |
|---|---|---|---|
| 3408216 | 9/1984 | Fed. Rep. of Germany | 174/142 |
| 803017 | 2/1981 | U.S.S.R. | 174/142 |

*Primary Examiner*—Laramie E. Askin

*Attorney, Agent, or Firm*—Fitch, Even, Tabin & Flannery

[57] ABSTRACT

A high voltage bushing for use in a plasma environment. The bushing is adapted for mounting through a wall of a pressure vessel or the like and includes an elongate insulator having a central bore receiving an electrical conductor. The insulator has a lower portion extending through an opening in the wall and an upper portion extending away from the wall. Mounting hardware is included for retaining the lower portion in the opening. A terminal is held adjacent the free end of the insulator upper portion with the terminal connected to the conductor. The bushing further includes a number of resistive rings positioned about the upper portion of the insulator and a number of annular metallic fins also positioned about the upper portion of the insulator. One of the fins is disposed between each pair of adjacent rings, and the fins extend outwardly beyond the rings. The resistive rings provide voltage grading along the length of the bushing and the presence of the fins reduces the distance between conductive components between the terminal and the wall to limit avalanche growth of electrons.

13 Claims, 2 Drawing Sheets

ELECTRICAL INSULATOR FOR USE IN PLASMA ENVIRONMENT

This invention was made with Government support under contract DNA001-86-C-0283-PZ0002 awarded by the Defense Nuclear Agency. The Government has certain right in this invention.

This invention relates to electrical insulators and, more particularly, to a high voltage bushing for use in a plasma environment such as would be experienced by a satellite in low earth orbit.

BACKGROUND OF THE INVENTION

A satellite in low earth orbit (usually considered between 200 km to 1000 km above the earth's surface) encounters a plasma environment having low background pressures and high electron and ion densities. The background pressures can be about $10^{-7}$ torr while the electron and ion densities may be about $10^5/cm^3$. Standard bushings and insulators have proved unsuitable for use in such an environment when the voltage is above a few hundred volts. In such a low background pressure, the insulator outgasses and desorbs adsorbed or absorbed gasses. This results in higher local pressure near the insulator. These gasses ionize and ions impinge on the insulator surface causing secondary electron emission. Above a few hundred volts, these conditions result in flashovers on the insulator surface.

A very high voltage (up to one million volts) bushing has been proposed for bringing a conductor into a vacuum vessel. This bushing includes an inner tube of a resistive material receiving the conductor. A stack formed by alternating annular glass members and aluminum rings surrounds the tube with rings engaging the tube. A field shaping ring is held by each aluminum ring to partially cover adjacent glass members. In order to fit the tube inside of the aluminum rings, the tube is contracted by cooling or vacuum and, after insertion into the rings, is allowed to expand. For further information concerning the structure and operation of such a bushing, reference may be made to U.S. Pat. No. 3,126,439.

SUMMARY OF THE INVENTION

Among the various aspects and features of the present invention may be noted the provision of an improved bushing for use in a plasma environment. The bushing functions to provide a voltage grading along its length between its terminal and the support to which it is attached. This voltage grading results in conduction current to provide for removal of accumulated charges on the surface of the bushing. The bushing also operates to limit avalanche growth of electrons by limiting the distance between conductors along the length of the bushing. Furthermore, the bushing limits the number of charged particles impinging on surfaces of the bushing which otherwise would result in charging of the insulators. Additionally, the bushing of the present invention is reliable in use, has long service life and is relatively easy and economical to manufacture. Other aspects and features of the present invention will be, in part, apparent and, in part, pointed out hereinafter in the following specification and in the accompanying drawings.

Briefly, a high voltage bushing embodying various aspects of the present invention includes an elongate tubular insulator having an axial bore for receiving a conductor. The insulator has a first end for mounting on a container wall having an opening through which this first end extends, and the insulator has a second end for holding a terminal for connection to the conductor. A number of rings formed of material which is a bulk resistor are positioned about the insulator between the first and second ends. Additionally, a number of annular metallic fins are positioned about the insulator between the ends. One of the fins spaces each pair of adjacent rings and each fin includes a central section extending substantially normal to the axis of the bushing, and a skirt section disposed outwardly of the rings and extending in the axial direction of the bushing for shading one of the pair of rings from ion bombardment.

DESCRIPTION OF THE PREFERRED EMBODIMENTS

Figure 1:
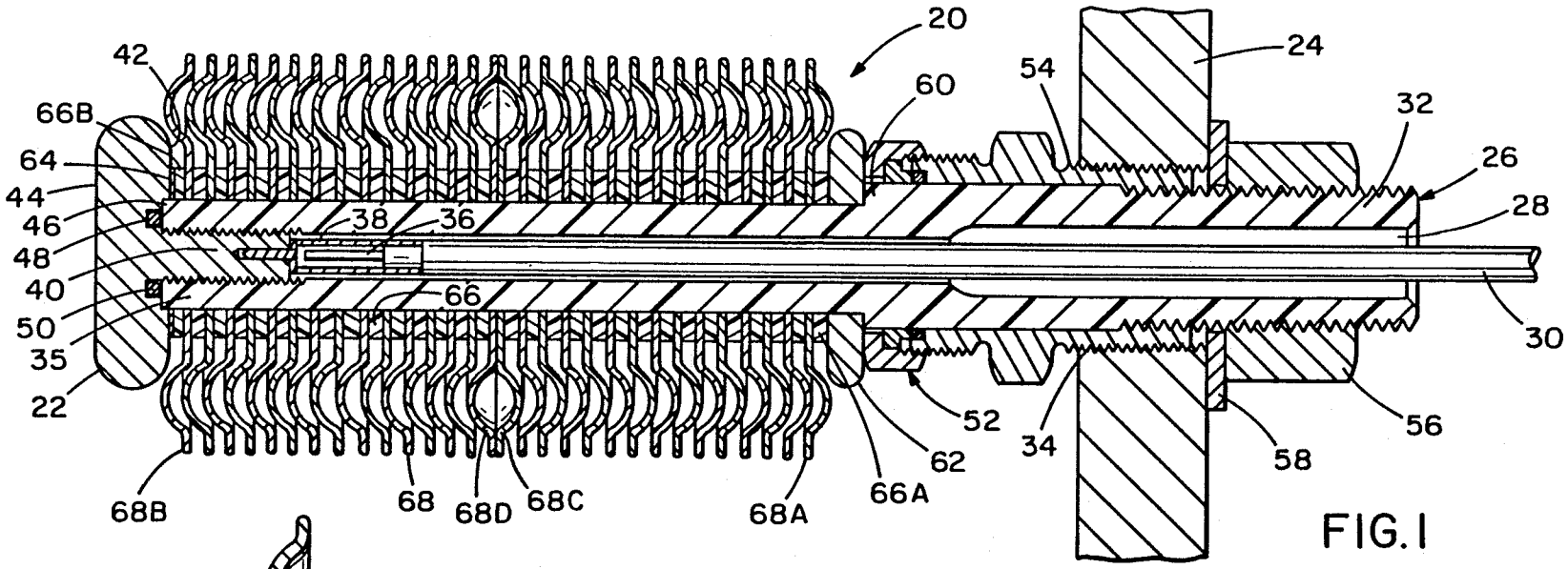
FIG. 1 is a cross-sectional view of a high voltage bushing, embodying various aspects of the present invention, mounted on a wall.

Referring now to the drawings, a high voltage bushing embodying various aspects of the present invention is generally indicated in FIG. 1 by reference numeral 20. The bushing 20 is particularly intended for use in a plasma environment, such as characterized by low background pressure and high electron and ion densities. The busing 20, which has a total length less than 230 mm, can withstand an applied voltage of 12 kV dc, 25 KV pulsed without flashover assuming electron densities of $10^5/cm^3$. This voltage is between a high voltage terminal 22 at the distal or upper end of the bushing and a wall 24 of a container, such as a pressure vessel, a transformer or a capacitor, on which the bushing is mounted.

More specifically, the bushing includes an elongate tubular insulator 26 having a central bore 28 receiving a conductor 30. The insulator includes a lower portion 32 extending through an opening 34 in the wall 24, and an upper portion 35 extending away from the wall 24. The conductor 30 could be a coaxial cable with its shield (not shown) connected to the wall 24 and its core 36 terminated in a banana plug 38 the spring tip of which is received in a socket defined by the stem 40 of the T-shaped terminal 22. The stem has an external screw thread mating with an internal thread in the bore 28 to hold the terminal. The underside 42 of the crown 44 of the terminal has a first annular groove 46 receiving the distal end of the insulator 26, and a second annular groove 48, opening onto groove 46 receiving an O-ring 50 to establish a gas tight seal between the crown and the insulator. The insulator is preferably formed of Lexan (a registered trademark of the General Electric Co. for thermoplastic polycarbonate resin).

The lower portion 32 of the insulator extends through the bore of a mounting means which may take the form of a gas tight male connector assembly 52 having a base 54 with an external screw thread mating with an internal thread defining the wall opening 34. This connector assembly is commercially available, an example of which is the ULTRA-TORR male connector manufactured by the Cajon Company, Solin, Ohio. Accordingly, this assembly need not be further described here. The insulator lower portion has an external screw thread for engagement by a nut 56 on the inside of the wall 24 and spaced therefrom by a washer 58.

Figure 3:
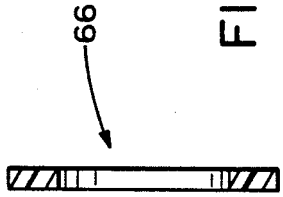
FIG. 3 is an enlarged cross-sectional view of a ring of material which is a bulk resistor included in the bushing of FIG. 1.
Figure 2:
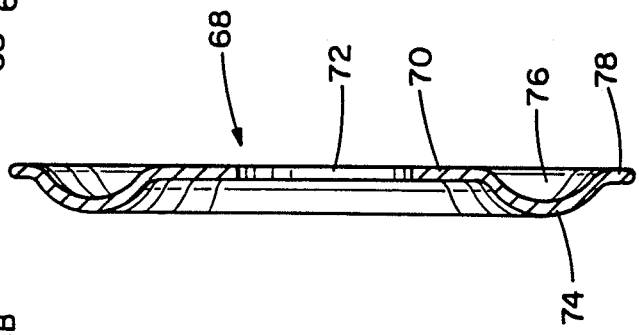
FIG. 2 is an enlarged cross-sectional view of a conductive fin used in the bushing of FIG. 1.

Seated by a shoulder 60 on the insulator is a washer 62 which serves as a lower annular abutment receiving the insulator. A second washer 64, engaged by the underside 42 of the terminal crown 44, serves as an upper abutment receiving the insulator. Compressively held between these abutments is a stack formed by a plurality of resistive rings 66 and a plurality of annular metallic fins 68, with one of the fins being positioned between each pair of adjacent rings. One of the fins 68 is best shown in FIG. 2, while a resistive ring 66 is best shown in FIG. 3. There are preferably about 36 rings including a lowermost ring 66A in full surface engagement with the lower washer 62 and an uppermost ring 66B in full surface engagement with the upper washer. There is also preferably an identical number of fins 68, including fins 68C, 68D in back-to-back relationship midway between the washers 62, 64.

Referring to FIG. 2, each fin 68 is preferably formed of aluminum and includes a central section 70 defining an opening 72 receiving the upper portion 35 of the insulator 26. The fin further includes a skirt section 74 disposed outwardly of the central section and extending, as shown in FIG. 1, in the axial direction of the bushing 20 for shading one of the rings from ion and/or electron bombardment. More specifically, the skirt section is arcuate and folds back on itself, defining a cavity 76. The skirt section of one fin extends into the cavity defined by the next adjacent fin so that there is no linear path between these fins to the resistive ring 66 between the fins, thereby fully blocking linear motion ion impingement.

As shown in FIG. 1, the skirt section of the lowermost fin 68A extends toward the lower washer 62 to shade ring 66A, while the skirt section of the uppermost fin 68B extends toward the upper washer 64 to shade ring 6B. Fins 68A and 68C along with fins disposed therebetween form a group or lower fins, while fins 68B and 68D along with fins disposed therebetween form a group of upper fins. Each pair of adjacent fins, except for the pair formed by 68C and 68D, is substantially equally spaced and with the facing central sections 70 being in substantially full surface contact with the resistive ring 66 disposed therebetween. Furthermore, each fin is identical and has substantially uniform thickness. Each fin also includes an outer brim 78, extending generally normal to the axis of the bushing, for electric field shaping.

Figure 4:
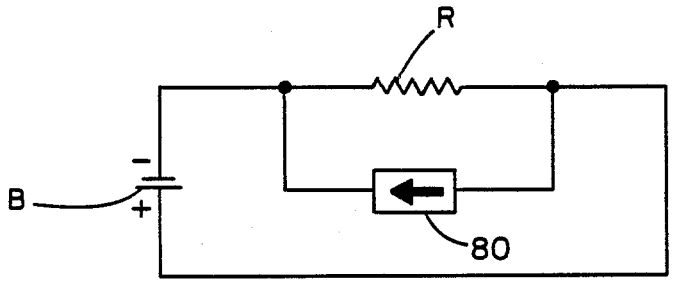
FIG. 4 is an electrical schematic representation of a lumped component circuit equivalent to the bushing of FIG. 1.

Each of the resistive rings 66 is identical and is formed of a material which is a bulk resistor, a preferred material being epoxy graphite. Upon tightening of the nut 56, the insulator 26 is drawn inwardly, causing the crown 44 to compress the stack of rings 66 and fins 68 between the washers 62 and 64. This establishes good electrical contact between adjacent rings and fins. An equivalent circuit of the bushing 20 is shown in FIG. 4 in which the anode and cathode of the battery B are formed by the wall 24 and high voltage terminal 22, respectively. The resistor R is the equivalent of the stack of rings 66 while the current source 80, shunting resistor R, represents the current resulting from the plasma.

Figure 5:
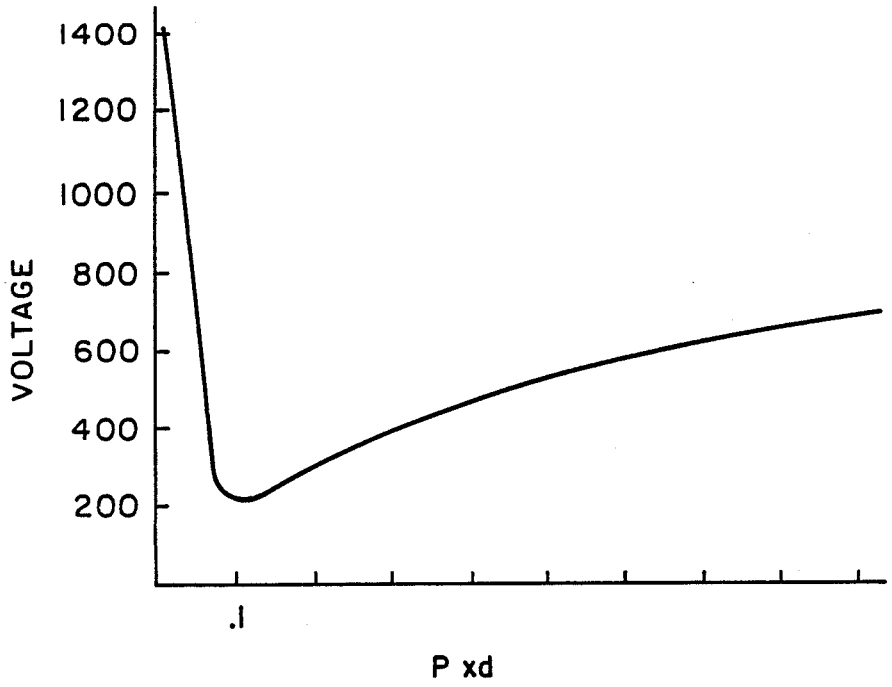
FIG. 5 is a plot of an exemplary Pachen curve indicating breakdown voltage versus the product of pressure and distance, used as an aid in explanation of the operation of the bushing.

FIG. 5 shows an exemplary Paschen curve, with the vertical axis representing the magnitude of breakdown voltage required for flashover and the horizontal axis being a measure of the product of distance between adjacent conductors along the bushing outer surface multiplied by pressure. Note that the lowest breakdown voltage occurs at about 0.1 torr centimeter. By segmenting the outer surface of the bushing through the use of the spaced conductive fins 68, thereby reducing the spacing between adjacent conductors, the bushing 20 operates in the relatively steep portion of the Paschen curve to the left of the minimum breakdown voltage, thereby greatly increasing the maximum applied voltage before flashover. The resistance of each ring is about 500k while the thickness of each ring (also the spacing between adjacent fins) is 2.3 mm. If within the limits of the mechanical strength of the resistive material, the thickness can be further decreased, an even higher applied electric field can be withstood by the bushing without surface flashover.

The failures of prior art bushings in a plasma environment are primarily due to surface charging and secondary electron emission from the insulator surface due to impingement of the accelerated ions and/or electrons on the insulator surface, resulting in surface flashovers. Of course, such flashovers can result in carbon tracking, further reducing the breakdown voltage. The construction of bushing 20 minimizes these effects because the fins are shaped to reduce the number of charged particles, and resulting charging currents, reaching the outer surfaces of the resistive rings. Such impingement frees electrons from the ring surfaces. However, as the number of striking particles is reduced, the production of secondary electrons at the ring surfaces is lowered. The voltage grading along the stack of resistive rings functions to remove any accumulated surface charge. The resistivity of the rings causes the conduction current through the bushing (less than 1 milliamp) to be greater than the plasma current. Secondary electrons from the fins can replace electrons removed from the resistive rings due to ion bombardment, thereby controlling charging of the rings.

The rings have sufficient thickness that the voltage drop across any one individual ring is below a voltage roughly corresponding to the Paschen minimum voltage for breakdown. Because there is already a plasma present in the space between the aluminum fins 68, the term "breakdown" has little meaning. However, according to Townsend's theory, the threshold for arc formation is the electric field at which $$\gamma(E)e^{\alpha}(E)d=1$$

where $\gamma(E)$ and $\alpha(E)$ are the first and second Townsend ionization coefficients, respectively, and are functions of the electric field E and the background gas characteristics, and d is the distance between the electrodes (fins). For further information concerning Townsend theory and the first and second ionization coefficients, reference may be made to *Electrical Breakdown of Gases* by Meek and Craggs, Oxford Press, 1953, pp. 11–12, 67–68 and 80–84. Because this threshold is dependant upon d, if the maximum value for d is limited by segmenting the total distance across which the voltage is applied with conducting fins, the avalanche growth of electrons is limited. This serves to prevent the formation of both arcs and surface flashovers along the insulator.

Figure 6:
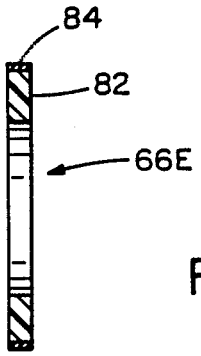
FIG. 6, similar to FIG. 3, shows an alternative embodiment of the ring in which an insulator has a conductive outer coating.

Referring to FIG. 6, an alternate embodiment of the resistive ring is indicated by reference character 66E. Resistive ring 66E is formed by an insulator 82 having an outer conductor coating 84. The insulator could be glass or porcelain while the coating could be epoxy loaded with graphite. Accordingly with the stack formed by resistive rings 66E, a conduction current flows along the outer surface of the rings to achieve the same results discussed above. However, the use of the resistive ring 66 formed of a material which is a bulk resistor is generally preferred due to the much greater cross section through which the current flows to achieve significantly greater heat dissipation.

While the present invention has been discussed above in the context of a bushing, it will be appreciated that likewise advantageous results occur when the invention is configured as a support insulator. The bushing of FIG. 1 can be made into a support insulator by simply not using the conductor 30 or by replacing the insulator 26 with a cylindrical member of insulative material. The device can then be used to hold a component, such as a high voltage conductor, spaced from a support such as the wall 24.

In view of the above, it will seen that the several objects of the invention are achieved and other advantageous results attained.

As various changes could be made without departing from the scope of the invention, it is intended that all matter contained in the above description or shown in the accompanying drawings shall be interpreted as illustrative and not in a limiting sense.

What is claimed is:

1. A high voltage bushing for use in a plasma environment, such as would be experienced by a satellite in low earth orbit, said bushing being adapted for mounting through a wall of a pressure vessel or the like and comprising:

an elongate insulator having a central bore receive conductor, said insulator having a, lower portion for extending through an opening in a wall and an upper portion for extending away from said wall;

mounting means for retaining said lower portion said said opening;

a terminal held adjacent the distal end of said upper portion, said terminal being connected to said conductor;

a plurality of resistive rings disposed about the upper portion of said insulator;

a plurality of annular metallic fins disposed about the upper portion of said insulator, one of said fins being disposed between each pair of adjacent rings, said fins extending outwardly beyond said rings whereby said resistive rings provide voltage grading along the length of said bushing and the presence of said fins reduces the distance between conductive components between said terminal and said lower portion to limit avalanche growth of electrons.

2. A bushing as set forth in claim 1 wherein each of said metallic fins comprises a central section extending substantially normal to the axis of said bushing, said central section being in substantially full surface contact with at least one of the pair of resistive rings it spaces throughout their coextension, each of said fins further comprising a skirt section disposed outwardly of said rings and extending in the axial direction of said bushing for shading one of said pair of rings from ion bombardment.

3. A bushing as set forth in claim 2 wherein said skirt section is arcuate and folds back on itself to define a cavity, the skirt section of one fin extending into the cavity defined by the next adjacent skirt section to block any linear path to the associated resistive ring.

4. A bushing as set forth in claim 2 further comprising a lower annular abutment receiving said insulator and disposed adjacent said lower portion and an upper annular abutment receiving said insulator and disposed adjacent said terminal, said resistive rings and said fins forming a stack compressively held between said upper and lower abutments.

5. A bushing as set forth in claim 4 wherein the lowermost resistive ring is disposed closer to said lower abutment than is the lowermost fin, the uppermost resistive ring being positioned closer to said upper abutment than the uppermost fin, a group of lower fins including at least said lowermost fin having their skirt sections extending toward said lower abutment so that said lowermost fin shades said lowermost ring, the remaining fins having their skirt sections extending toward said upper abutment so that the uppermost fin shades the uppermost ring.

6. A bushing as set forth in claim 5 wherein the central section of the uppermost one of said group of fins engages the central section of the lowermost of said remaining fins.

7. A bushing as set forth in claim 2 wherein each pair of adjacent fins is substantially equally spaced, each fin is identical in shape, and each fin is of substantially uniform thickness throughout its extension.

8. A bushing as set forth in claim 1 wherein each ring is formed of a material which is a bulk resistor.

9. A bushing as set forth in claim 8 wherein said material is epoxy graphite

10. A bushing as set forth in claim 1 wherein each of said rings is an insulator having a conductive outer layer.

11. A bushing as set forth in claim 1 wherein said insulator is tubular and is formed of a thermoplastic polycarbonate resin.

12. A high voltage bushing for use in a plasma environment, said bushing having an axis and comprising:

an elongate tubular insulator having an axial bore for receiving a conductor, said insulator having a first end for mounting on a container wall having an opening through which said first end is to extend, said insulator having a second end for holding a terminal for connection to said conductor;

a plurality of rings formed of material which is a bulk resistor positioned about said insulator between said first and second ends; and a plurality of annular metallic fins disposed about said insulator between said first and second ends, one of said fins being disposed between each pair of adjacent rings, each fin including a central section extending substantially normal to the axis of said bushing and a skirt section disposed outwardly of said rings and extending in the axial direction of said bushing for shading one of the pair of associated rings from ion bombardment

13. A high voltage insulator for use in a plasma environment, said insulator having an axis and comprising:

an elongate cylindrical member of insulative material, said member having a first end for mounting on a support, said member having a second end for holding another component spaced from said support;

a plurality of rings formed of material which is a bulk resistor positioned about said member between said first and second ends; and a plurality of annular metallic fins disposed about said member between said first and second ends, one of said fins being disposed between each pair of adjacent rings, each fin including a central section extending substantially normal to the axis of said bushing and a skirt section disposed outwardly of said rings and extending in the axial direction of said insulator for shading one of the associated pair of associated rings from ion bombardment

* * * * *

UNITED STATES PATENT AND TRADEMARK OFFICE

CERTIFICATE OF CORRECTION

PATENT NO. : 4,835,341

DATED : May 30, 1989

INVENTOR(S) : Ira Katz et al.

It is certified that error appears in the above-identified patent and that said Letters Patent is hereby corrected as shown below:

Column 1, line 8, change "right" to --rights--.

Column 2, line 26, change "Pachen" to --Paschen--.

Column 2, line 31, after "the" insert --resistive--.

Column 2, line 42, change "busing" to --bushing--.

Column 2, line 44, change "KV" to --kV--.

Column 2, line 44, after "pulsed" insert --(100μs)--.

Column 3, line 48, change "6B" to --66B--.

Column 5, line 43, change "receive" to --receiving a--.

Column 5, line 44, after "a" delete the comma (second occurrence).

UNITED STATES PATENT AND TRADEMARK OFFICE

CERTIFICATE OF CORRECTION

PATENT NO. : 4,835,341

DATED : May 30, 1989

INVENTOR(S) : Ira Katz et al.

It is certified that error appears in the above-identified patent and that said Letters Patent is hereby corrected as shown below:

Column 5, line 47, change "said" to --in-- (second occurrence).

Column 6, line 40, after "graphite" insert a period.

Column 6, line 66, after "bombardment" insert a period.

Column 8, line 9, after "bombardment" insert a period.

Signed and Sealed this

Twenty-seventh Day of February, 1990

*Attest:*

JEFFREY M. SAMUELS

*Attesting Officer*

*Acting Commissioner of Patents and Trademarks*